US012502590B2

(12) United States Patent
Kuit et al.

(10) Patent No.: US 12,502,590 B2
(45) Date of Patent: Dec. 23, 2025

(54) GOLF CLUB HEAD

(71) Applicants: Winston King-Loong Kuit, Richmond (CA); Daniel Joseph Seifried, Richmond (CA)

(72) Inventors: Winston King-Loong Kuit, Richmond (CA); Daniel Joseph Seifried, Richmond (CA)

(73) Assignees: Winston King-Loong Kuit, Richmond (CA); Daniel Joseph Seifried, Richmond (CA)

( * ) Notice: Subject to any disclaimer, the term of this patent is extended or adjusted under 35 U.S.C. 154(b) by 151 days.

(21) Appl. No.: 18/479,476

(22) Filed: Oct. 2, 2023

(65) Prior Publication Data

US 2025/0108282 A1 Apr. 3, 2025

(51) Int. Cl.
*A63B 69/36* (2006.01)
*A63B 53/04* (2015.01)

(52) U.S. Cl.
CPC ..... *A63B 69/3614* (2013.01); *A63B 53/04* (2013.01); *A63B 69/3632* (2013.01); *A63B 69/3685* (2013.01)

(58) Field of Classification Search
CPC ... A63B 53/04; A63B 53/047; A63B 53/0441; A63B 53/0487; A63B 69/36; A63B 69/3614; A63B 69/3632; A63B 69/3685; A63B 2209/08; A63B 71/0622; A63B 2071/0694; A63B 60/46; A63B 60/40
See application file for complete search history.

(56) References Cited

U.S. PATENT DOCUMENTS

| | | | | |
|---|---|---|---|---|
| 2,919,922 | A * | 1/1960 | Skelly | A63B 69/3685 D21/737 |
| 6,227,983 | B1 * | 5/2001 | Yang | A63B 69/3685 473/220 |
| 9,132,325 | B2 | 9/2015 | Whitlam | |
| 11,731,009 | B1 * | 8/2023 | Judge | A63B 69/3685 473/282 |
| 12,233,317 | B1 * | 2/2025 | Rahman | A63B 53/0487 |
| 2006/0293112 | A1 * | 12/2006 | Yi | A63B 60/00 473/241 |
| 2007/0167248 | A1 * | 7/2007 | Fler | G02B 23/105 473/220 |
| 2009/0181784 | A1 * | 7/2009 | Wilson | A63B 69/3685 473/250 |
| 2013/0143684 | A1 * | 6/2013 | Painter | A63B 69/3661 473/409 |
| 2017/0036094 | A1 * | 2/2017 | Kim | A63B 53/007 |
| 2017/0144038 | A1 * | 5/2017 | Nessar | A63B 69/3685 |
| 2017/0368438 | A1 * | 12/2017 | Landsman | A63B 69/3608 |
| 2019/0232121 | A1 * | 8/2019 | Greaney | A63B 53/0466 |
| 2021/0379465 | A1 | 12/2021 | Bareno | |

FOREIGN PATENT DOCUMENTS

| | | | | |
|---|---|---|---|---|
| KR | 102031298 | * 10/2019 | | A63B 53/0487 |

* cited by examiner

*Primary Examiner* — John E Simms, Jr.

(57) ABSTRACT

Example of a golf club head are described. The golf club head has a body extending between heel end and the toe end. A groove is formed in a top surface of the body in proximity and parallel to a face surface. The groove is forming a cavity with a securing element coupled to the cavity wall to removably receive and secure a camera body therein.

11 Claims, 4 Drawing Sheets

GOLF CLUB HEAD

FIELD OF INVENTION

This invention relates to a golf club and more particularly to a golf club head with a groove for positioning a camera for taking images and video recording during a golf training process.

BACKGROUND OF INVENTION

Unless otherwise indicated herein, the materials described in this section are not prior art to the claims in this application and are not admitted being prior art by inclusion in this section.

Learning how to play golf and/or to perfect skills as a player to achieve competitive results is very important to be able to record movements while addressing a golf ball with golf club and how to position body, feet, golf ball and pin position. A golf swing is difficult to capture because its speed is occurring in a blink of an eye and therefore it is essential to capture every part of the movement. When recording the training opportunity golfer can analyze and visualize swing data in slow motion without missing out any important data. This is helping golfer to compare feedback data and peak of performance and to adjust individual golfing characteristics.

In general recording of the swings is done by camera mounted on the ground or on a stalk or attached to an upper edge of a clubhead. When camera is positioned on the stalk there is a need to adjust height on the stalk according to golfer height, body, hands and feet position, distance between golfer and the camera and its angle. This is a difficult process for capturing all the aspects of the swing. When camera is positioned on the ground there is a need of equipment to hold the camera on the level of the ball with adjusting the distance of golfer and whole golf club. There is also option to hit the camera while swinging the ball damaging the camera and missing the recording. In case when the camera is mounted on the upper surface on the clubhead there is a great possibility the camera to be disengaged from the clubhead during the swing moment resulting in damaged camera and obstructed the imaging/recording.

The known prior art may attempt to address the proper recording and positioning of the camera, however such prior art is either inefficient or expensive considering that the golf cameras are specially designed to capture speed of the swing. Another limiting factor is that the golfer need to additionally learn how to use the imaging system or to properly position the camera.

SUMMARY OF INVENTION

In one aspect, a golf club head with a groove is provided. The club head comprises a body extending between a heel end and a toe end of the club head. A face surface is formed between a top surface and a bottom surface of the club head and is configured for striking a ball. A groove is formed in the top surface in proximity and parallel to the face surface, such that is forming a cavity with two spaced apart walls and side ends. The cavity is configured to removably receive a camera body therein such that a camera's objective is out and unobstructed of the cavity's walls or the golf club parts. A securing element is coupled to the walls of the cavity to tightly secure the camera within the cavity.

In one aspect, the securing element includes a gripping and/or friction surface to couple with the camera in strong and tight connection.

In another aspect, the securing element includes a magnet connected to at least one wall of the cavity to couple with the camera in strong and tight connection.

In another aspect, golf head with grove comprises a controller for processing images or recordings received from camera. The controller is connected to the camera wirelessly via Bluetooth or optionally with wires.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

DETAILED DESCRIPTION OF SPECIFIC EMBODIMENTS

The present invention is directed to a golf clubhead with a specially designed groove forming a cavity for inserting a camera therein for precise imaging and/or video recording of a golf swings during for example training process. The images and/or video recordings can be stored in a memory (e.g., camera memory unit) for reviewing by the player or coach, allowing them to analyze and watch the images and/or video recordings of the last swings and compare them with stored images/video recordings of past swings as well as analyzing results such as position of a golf ball on a pin, its level with the golf head, distance between the ball and golf head, swing angle and speed of the ball and its trajectory after the hit. In addition, the images and the recorded videos can be used for making educational content for training purposes and/or to share with community via social media. After the recording is processed it is giving the player information for implementing adequate technique for movement of a body, golf club and angle of hitting the ball for achieving competitive results. The swing speed is measured in a couple of seconds, and it is essential to capture any movement with the camera. The camera position and height in a view of the golf ball is very crucial as well as assuring the camera is still and preventing any camera movements during the swing, such that the camera is secured, firm and reliable in the groove.

Figure 1:
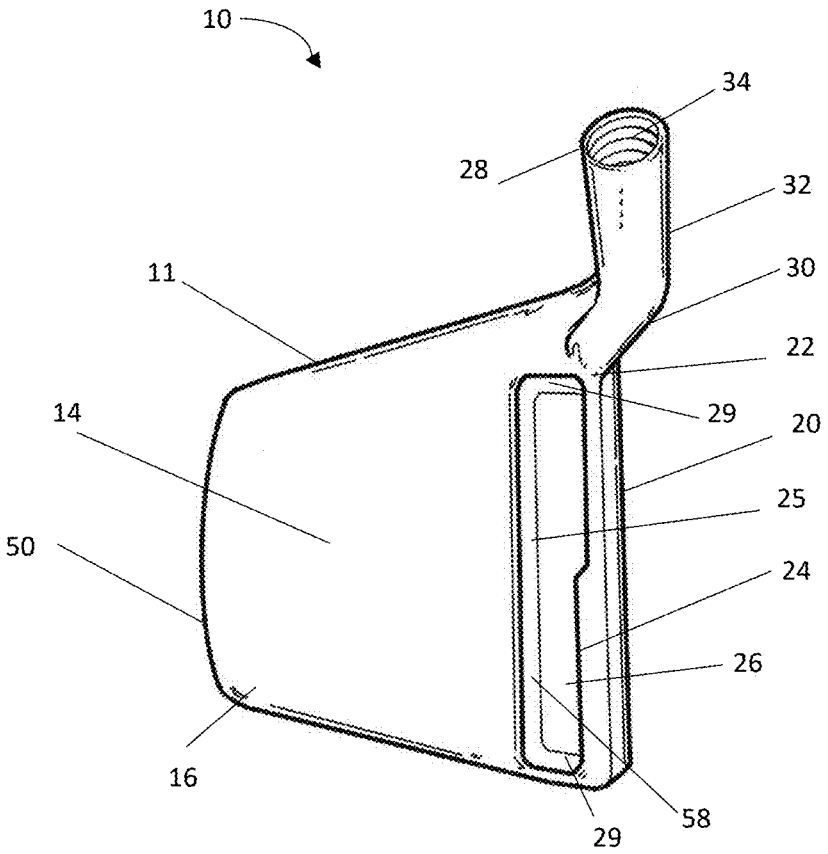
FIG. 1 is a top view of a golf clubhead with a groove.

FIG. 1 illustrates an example a golf club head 10 with a groove 24. The clubhead 10, has a body 11 with a generally planar top surface 14 and a bottom surface or sole 12 (see FIG. 4). The body 11 of the clubhead 10 extends between a toe end 16 which is the furthest point of the clubhead from the player when the player is holding the club, to a heel end 22 which is the closest point of the clubhead 10 when the player is holding the club. The clubhead 10 has a face surface 20 that is configured for striking a ball, e.g., a golf ball. The furthest from the face surface 20 of the clubhead 10 is a rear surface 50, that is opposite of face surface 20. The sole (bottom surface) 12 is the bottom part of the clubhead 10 that includes a grind 13 configured to rest on the turf. The groove 24 is forming a cavity 26 that extends from the top surface 14 towards the bottom surface 12. The cavity 26 has two spaced apart walls 25 that are substantially parallel to the face surface and is sized and design to removably receive a camera 27 (see FIG. 2).

The cavity 26 has a securing element 58 coupled to at least one wall 25 on the surface facing the cavity 26. The securing element 58 is configured to fit in the cavity 26 and is designed to provide a gripping and/or friction surface to firmly hold the camera's body 27 within the cavity 26 when the camera 27 is inserted therein to prevent camera movement or dislodging during swing/strike the ball. The gripping and/or friction surface can be made from a silicon, rubber, or any materials with similar gripping and/or friction properties. Alternatively, the securing element 58 can comprise a magnet positioned within the groove 24, for example fixed on at least one of the side walls 25 of the cavity 26. The camera's body can comprise metal material so that it can be held firmly within the cavity 26 by the magnet.

In the illustrated example of FIG. 1, the clubhead 10 has closed side ends 29 so that the cavity 26 is enclosed with the walls 25 and side end walls 29. The cavity 26 is sized and shaped so that body of the camera 27 can tightly fit within the cavity 26. In one embodiment, the camera 27 can be a smart phone 44 with integrated camera. The cavity 26 is sized so that when the smart phone 44 is inserted within the cavity 26, the camera 27 (i.e., camera's objective and optics 23) are unobstructed by the cavity or any other parts of the golf club. In one embodiment, the cavity 26 can have one side end, such as for example, the side end 29 in proximity to heel end 22, to be closed side end, while the opposite side end is an open side end, so that the camera/smart phone can slide into the cavity 26 from the opened side end 29 and firmly held therein by the securing element 58.

The golf clubhead 10 can further comprise a neck member 30 extended angularly upwardly from the top surface 14 connected to a hosel 32 that is configured to receive a shaft (not shown) of the golf club (not shown). The hosel 32 can have a circular hollow body having outside wall with smooth surface and inside wall ending with a top edge 28. The inside wall can have a tread 34 extending downwardly from an edge 28 in closer proximity to the neck member 30 to couple the shaft in tight and secure connection with the head 10 and prevent any prospective disengagement of the head 10 from the shaft. The hollow body 34 can include any other engagement means including slip, plug members, pinned connector or custom fitted shafts etc.

Figure 2:
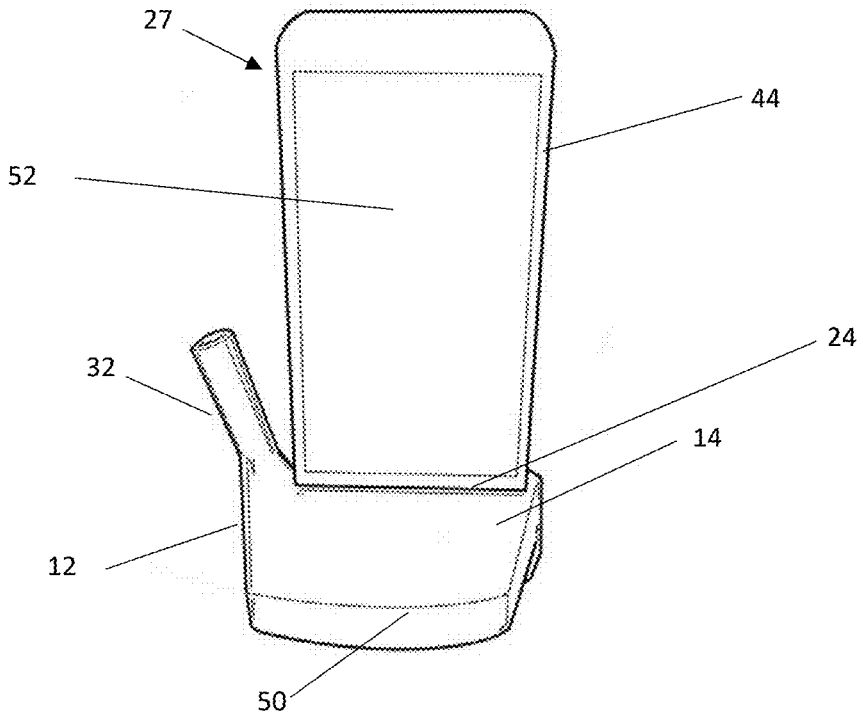
FIG. 2 is a front view of a golf clubhead with a camera inserted in a groove.

FIG. 2 illustrates a front view of the golf clubhead 10 with the groove 24 showing the smart phone 44 with the built-in camera 27. As illustrated in FIG. 2, a screen 52 of the smart phone 44 is facing the rear side 50 of the clubhead 10 while the camera 27 and camera's objective/lens 23 is facing towards the face surface 20 so that the player can have a close look at the position of the ball with respect to the face surface 20 right before the strike by looking in the screen 52 (see FIG. 6). The camera's lens 23 need to be unobstructed of any part of the clubhead and need to be positioned in proximity to the face surface 20 to allow to be aligned and in line of view with the ball and at the approximate height with ball's height.

The camera 27 can be turned on and off using a switch (not shown) that can be positioned on the shaft or the handle of the shaft. The switch is in communication with the camera 27 wirelessly via for example a Bluetooth or it can be connected to the camera with wires. In one embodiment, the switch can have a separate switch button for activating an imaging mode of the camera 27 for taking images of the swing and a video switch mode for activating a video recording mode for recording real time video of the player swing. The camera 27 can take images and/or video recordings of the angle of the clubhead 10 and the face surface 20 in relation to the ball during strike, ball movement and trajectory, etc. The taken images and/or video recordings can be stored in the camera's memory (e.g., smart phone 44 memory card) or can be transferred to a memory unit remote from the camera 27. The stored images and videos can be reviewed by the player or their coach for evaluation and teaching purposes, to create teaching content, or to be shared with the community using social media.

In one embodiment, at least a portion of the top surface 14 can be magnetic so that the camera 27 can be attachable thereon for taking selfie photographs and/or videos using the switch to remotely turn on/off the camera 27. The camera 27 can comprise front camera facing the screen 52 of the smart phone 44 and a back camera facing the back side 41 of the smart phone 44. For example, when the player wants to take selfie photo, they can put the smart phone 44 onto the magnetic surface on the top surface 14 of the clubhead 10, can swap the camera 27 to use the front camera lens/objective, and holding the club shaft looking into the screen 52 can take the desired selfie photo or video by pressing the switch as described herein before. In one implementation, the camera swap button can also be provided in the switch located at the shaft or handle of the club.

Figure 3:
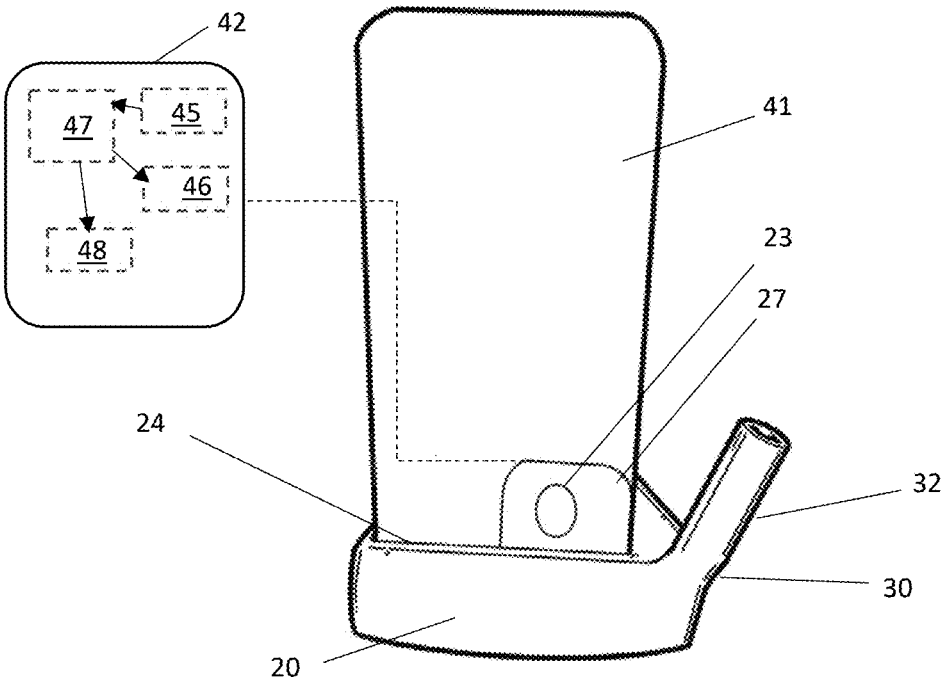
FIG. 3 is a back view of a golf clubhead with a camera mounted in a groove.

FIG. 3 illustrates a back view of the golf clubhead 10, showing the smart phone 44 in the cavity 26 and the camera's (e.g., back camera) lens/objective 23 protruding out of the cavity 26. The camera 27 of the phone 44 is positioned in region of the heel end 22 close to the hosel 32 and in parallel position with the face surface 20 of the golf clubhead 10. The groove 24 and the cavity 26 with securing element 58 are designed to securely hold the camera 27 therein, and in a direction and on an angle that is allowing proper recording without any necessary adjusting or positioning of the camera 27 in a view of the ball. The camera lens/objective can be aligned and in line of view with the ball and at the approximate height with ball's height.

A controller 42 can also be provided that can be in communication with the camera 27 wirelessly (e.g., via Bluetooth) or with wires. The controller 42 comprises an input unit 45 configured to receive captured images and/or video recordings from the camera 27, a processing unit 47, a memory unit 48 for storing images/videos and an output unit 46. The memory unit 48 can also comprise a library of stored swing strikes. The processing unit 47 can be preprogrammed with a set of instructions for analyzing the received images and/or recorded videos of player's swings and compare the images/video recordings with the images and video recordings stored in the library. The stored swings in the library can be player's previous reference swings or can be stored images/videos of preferred/desired swing results. The processing unit can then send an output signal to the output unit 46 and produce a recommendation to the player for correcting the swing and/or body position. For example, the recommendations can be displayed on the screen 52 or can be presented as an audio using the smart phone microphone. In addition, the images and videos can be used by the player or their coach for evaluation and teaching purposes, to create teaching content, or to be shared with the community using social media.

Figure 4:
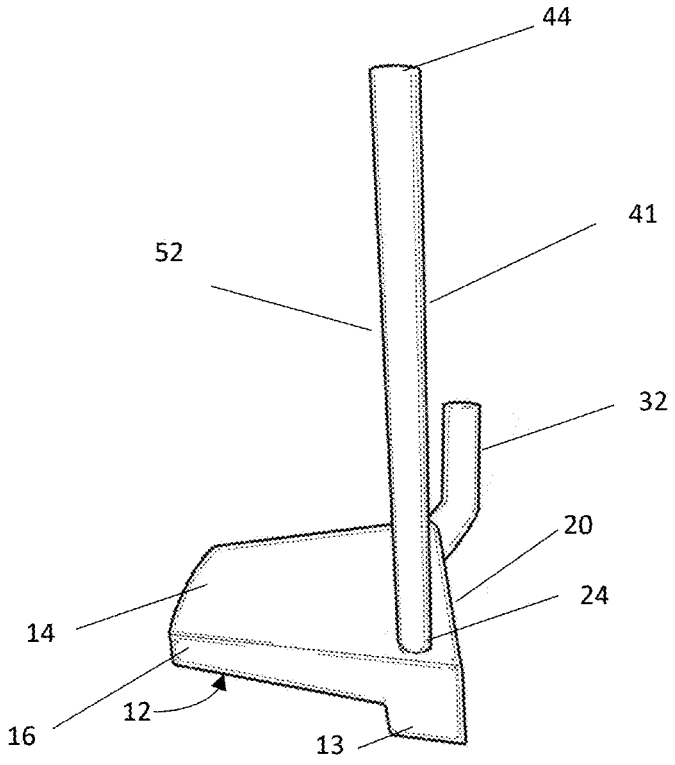
FIG. 4 is a side view of a golf clubhead with a camera mounted in a groove.

FIG. 4 illustrates one side view of the golf club head 10, showing the smart phone 44 inserted and secured in the cavity 26 with the phone screen 52 facing the rear surface 50, and the camera 27 facing the face surface 20 such that the lens 23 of the camera 27 is focused in the ball direction on an angle that is allowing proper recording without any necessary positioning or adjustment of the camera in a view of the ball.

Figure 5:
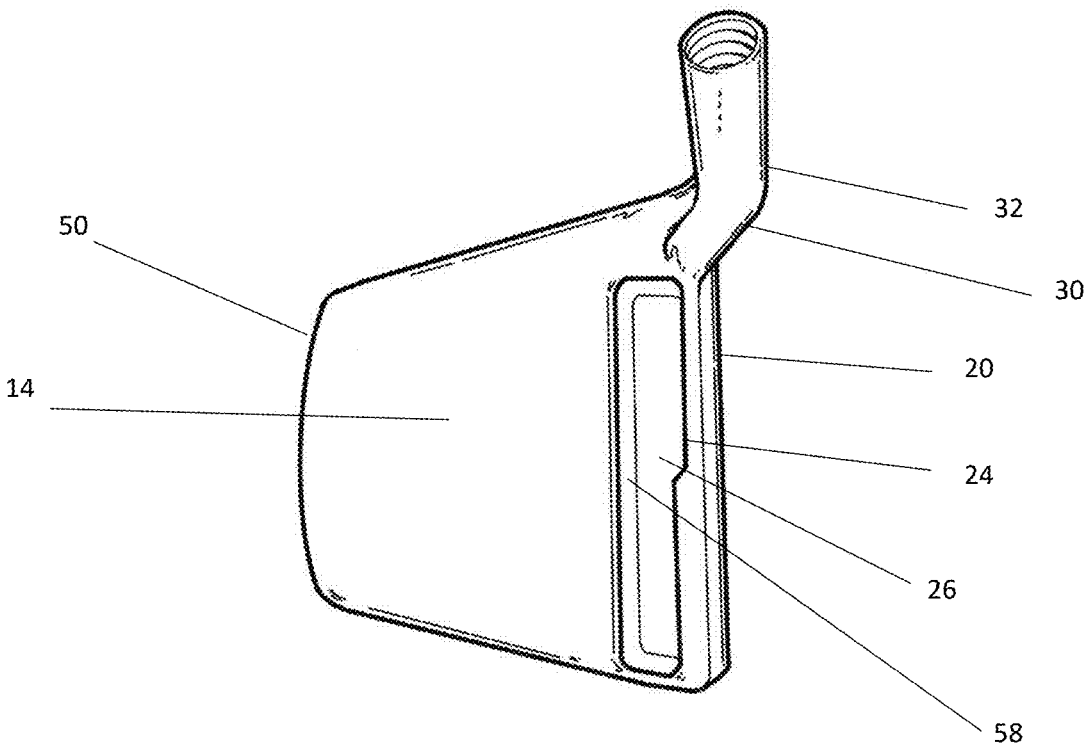
FIG. 5 is an environmental top view of a golf clubhead with a groove.
Figure 6:
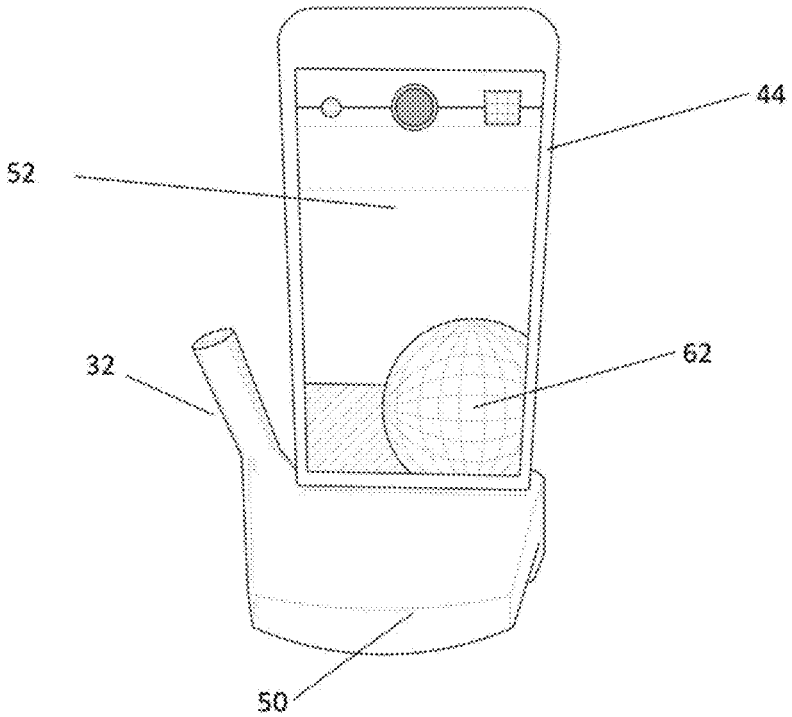
FIG. 6 is an environmental front view of a golf clubhead with a camera mounted in a groove.
Figure 7:
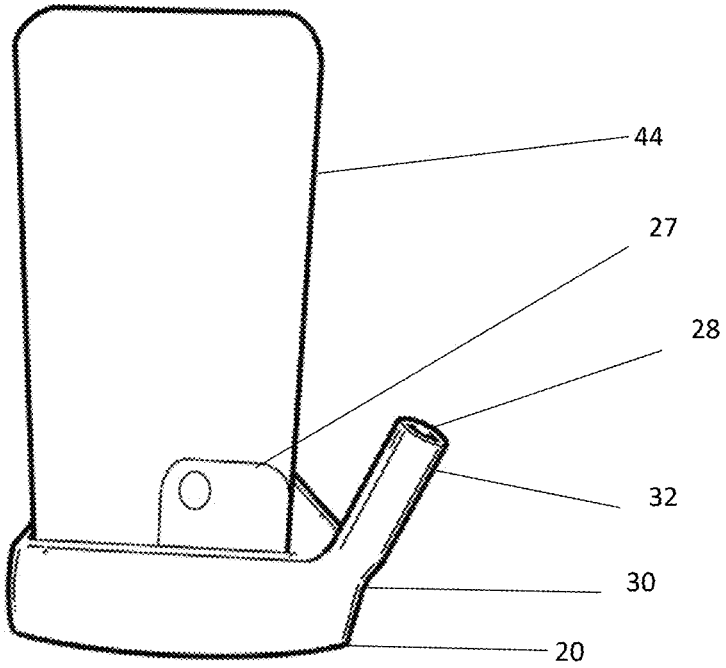
FIG. 7 is an environmental back view of a golf clubhead with a camera mounted in a groove.
Figure 8:
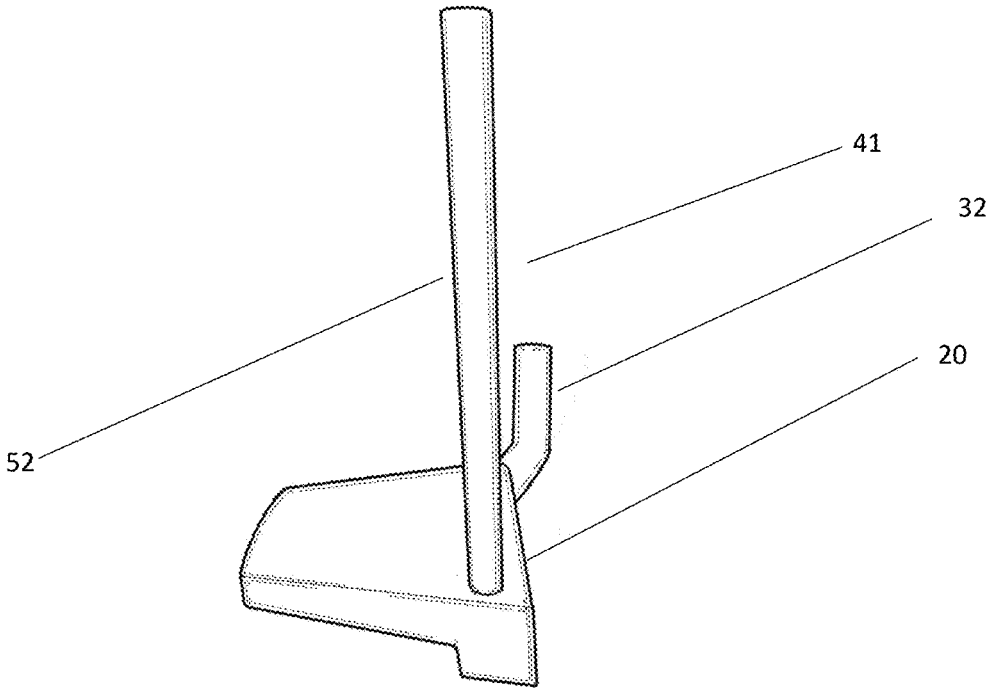
FIG. 8 is an environmental another side view of a golf club head with a camera mounted in a groove.

FIGS. 5-8 illustrate the environmental view of the FIGS. 1-4. For example, FIG. 5 is an environmental view of the clubhead 10 showing the groove 24 formed in the top surface of the clubhead 10 with no camera positioned in the cavity 26. FIG. 6 shows the clubhead 10 with the smart phone 44 inserted into the cavity 26. The camera 27 is facing and is aligned with the ball and the preview of image/video is shown on the screen 52 of the smart phone 44 for the player to see and review. The player can use the preview to readjust the position of the body, position of the club/clubhead or the position of the golf ball 62. The player can also then take a video recording or image(s) as well as see the swing, ball strike and ball trajectory in real time.

Throughout the description, specific details have been set forth in order to provide a more thorough understanding of the invention. However, the invention may be practiced without these particulars. In other instances, well-known elements have not been shown or described in detail, and repetitions of steps and features have been omitted to avoid unnecessarily obscuring the invention. Accordingly, the specification and drawings are to be regarded in an illustrative, rather than a restrictive, sense.

It will be clear to one having skill in the art that further variations to the specific details disclosed herein can be made, resulting in other embodiments that are within the scope of the invention disclosed. All parameters, dimensions, materials and configurations described herein are examples only and may be changed depending on the specific embodiment.

The invention claimed is:

1. A golf club head comprising:

a body of the club head extending between a heel end and a toe end;

a face surface formed between a top surface and a bottom surface of the club head and a rear surface opposite the face surface, the face surface configured for striking a ball;

a groove formed in the top surface in proximity and parallel to the face surface, the groove forming a cavity with two spaced apart walls and side ends, the cavity is configured to removably receive a camera therein such that a camera's objective is out and unobstructed of the cavity's walls; and a securing element coupled to the walls of the cavity to tightly secure the camera within the cavity, wherein the camera is a smart phone's camera.

2. The golf club head according to claim 1, wherein the securing element includes a gripping and/or friction surface coupled to at least one wall of the cavity.

3. The golf club head according to claim 2, wherein the securing element is made of a silicone and/or a rubber material.

4. The golf club head according to claim 1, wherein the securing element includes a magnetic surface position at least on one wall of the cavity.

5. The golf club head according to claim 1, further comprising a switch positioned on a handle of a golf club, the switch is in communication with the golf club to turn on/off the camera.

6. The golf club head according to claim 5, wherein the switch is connected with the camera via Bluetooth.

7. The golf club head according to claim 5, wherein the switch is connected with the camera with wires.

8. The golf club head according to claim 5, wherein the switch comprises a video button and/or an imaging button.

9. The golf club head according to claim 1, wherein the walls of the cavity are substantially parallel to each other and the face surface of the club head.

10. The golf club head according to claim 1 further comprising a magnet surface on at least portion of the top surface, the camera is removably attachable to the magnet surface.

11. The golf head according to claim 1, further comprising a controller in communication with the camera, the controller comprising an input unit configured to receive captured images and/or video recordings from the camera, processor unit, a memory unit storing a library of stored swing shots and an output unit, where the processing unit analyzes the received images and/or recorded video of user's swings and compare images/video recording with the images and video recordings stored in the library and produces a recommendation to a user for correcting the swing and/or body position.

* * * * *